United States Patent [19]

Kawabe et al.

[11] Patent Number: 4,707,867

[45] Date of Patent: Nov. 24, 1987

[54] TOILET-FLUSHING CONTROL APPARATUS

[75] Inventors: Ryoichi Kawabe, Kamagaya; Tetsuo Iwasaki, Tokyo; Hiroshi Kozuru, Noda; Masashi Yoda, Tokyo; Masakazu Matsunaga; Takesi Takamori, both of Asaka; Matao Nakasima, Kawagoe, all of Japan

[73] Assignee: F.M. Valve Manufacturing Co., Ltd., Saitama, Japan

[21] Appl. No.: 940,413

[22] Filed: Dec. 11, 1986

[30] Foreign Application Priority Data

Dec. 18, 1985 [JP] Japan ..... 60-282754

[51] Int. Cl.[4] ..... E03D 13/00

[52] U.S. Cl. ..... 4/313; 4/304; 4/623

[58] Field of Search ..... 4/302, 304, 313, 623, 4/300

[56] References Cited

U.S. PATENT DOCUMENTS

| | | | |
|---|---|---|---|
| 2,603,794 | 7/1952 | Bokser | 4/304 |
| 3,575,640 | 4/1971 | Ishikawa | 4/313 X |
| 3,863,196 | 1/1975 | Hilles | 4/304 X |
| 4,309,781 | 1/1982 | Lissau | 4/623 X |
| 4,651,777 | 3/1987 | Hardman | 4/623 X |
| 4,667,350 | 5/1987 | Ikenaga et al. | 4/304 |

*Primary Examiner*—Charles E. Phillips

*Attorney, Agent, or Firm*—Nixon & Vanderhye

[57] ABSTRACT

A toilet-flushing control apparatus comprising a detector, a delay circuit, a judging circuit, a first timer, a second timer, and a flush valve. The detector detects that a person is using a toilet, and outputs a signal. This signal is input to the delay circuit. Upon lapse of a predetermined time after receiving this signal, the delay circuit outputs a signal. The output signal of the delay circuit is supplied to the judging circuit. When the output signal of the detector lasts shorter than a reference time, the judging circuit determines that the toilet user has urinated. Conversely, when this signal lasts for the reference time or a longer time, the judging circuit determines that the toilet user has defecated. In the first case, the first timer is operated, and the flush valve opens for the time set to the first timer, thereby flushing the toilet. In the second case, the second timer is operated, and the flush valve opens for the time set to the second timer, thus flushing the toilet. The time set to the first timer is shorter than that set to the second timer. Hence, the toilet is flushed with a small amount of water after each urination, and with a large amount of water after each defecation.

6 Claims, 4 Drawing Figures

TOILET-FLUSHING CONTROL APPARATUS

BACKGROUND OF THE INVENTION (1) Field of the Invention

The present invention relates to an apparatus for automatically controlling the flushing of a toilet. More particularly, the invention relates to an apparatus which can detect that a person has finished using a toilet and also whether this person has defecated or urinated, and then automatically flushes the toilet with a great amount of water or a small amount of water, in accordance with whether the person has defecated or urinated.

(2) Prior Art

The conventional flush toilet has a handle coupled to a flush pipe valve. After using the toilet, the user operates this handle, thereby flushing the bowl with water and thus cleaning the bowl.

In the case of flush toilets installed in railroad stations, department stores, hotels, hospitals, schools, and the like, a few of the many users forget to flush the toilets after using them. The toilets are then left in an unsanitary condition. Another problem with the toilets for public use is that a user who loves cleanliness rather excessively tends to use more water than is necessary to flush the toilet. Further, some people flush the toilet continuously while they are using it, so that the sound of the flushing water drowns out embarassing noises produced during defecation or urination. This also results in an excessive use of water.

In order to eliminate these problems, various apparatus have been developed for automatically controlling the flushing of toilets. One of these apparatuses is designed to flush a toilet when the user closes the usually-open door of the toilet after entering and then opens the door after using the toilet. This apparatus is provided with a detector which can detect the closing and opening of the door, and automatically flushes the toilet every time the detector detects that the door is opened. However, this apparatus is disadvantageous in that the toilet is unnecessarily flushed if a clearning person closes the door when sweeping the floor of the bathroom or clearning the toilet.

Another of the conventional, toilet-flushing control apparatuses is designed to automatically flush a toilet when the user leaves the toilet. More specifically, this apparatus has a detector which can detect absorption of light or ultrasonic waves by a user, or the light or ultrasonic waves reflected from the user, or can detect heat radiated from the user, thereby to determine whether or not the toilet is occupied by a person. The apparatus automatically flushes the toilet when the detector detects that the user is leaving the toilet. This apparatus also unnecessarily flushes the toilet when a cleaning person cleans the bowl, hinged seat or lid of the toilet.

In either type of the prior art, the toilet-flushing control apparatus cannot flush the toilet with a small amount of water when the user has urinated, or with a large amount of water when the user has defecated. Some people use the same toilet for both urination and defection. Less water is required to flush and clean the bowl after urination than after defecation. The prior art apparatuses flush the toilet with a consistant amount of water, great enough to clean the bowl after defecation, even when the user has urinated, thereby resulting in an excessive use of water.

SUMMARY OF THE INVENTION

Accordingly, it is an object of the present invention to provide a toilet-flushing control apparatus which can automatically and reliably flush a toilet with a small amount of water whenever the toilet has been used for urination, and with a large amount of water whenever the toilet has been used for defecation, thereby always keeping the toilet bowl clean and preventing an excessive use of water.

According to the invention, there is provided a toilet-flushing control apparatus comprising a detector for detecting the presence a toilet user, a delay circuit, a judging circuit, a first timer, a second timer and a flush valve. The detector generates a signal when it detects that a user is seated on the hinged seat of a toilet. The signal is input to the delay circuit. The delay circuit outputs a signal when the signal from the detector stays at a high level for a predetermined period or a longer period. The output signal of the delay circuit is input to the judging circuit. The judging circuit determines whether or not the user has urinated or defecated by the length of the period during which the output signal of the delay circuit remains at a high level, that is, from the time the user occupied the toilet, as it has been determined that a defecation period would be necessarily longer than the predetermined (urination) period. When it determines that the user has urinated, the judging circuit supplies a standby signal to the first timer. When it determines that the user has defecated, the judging circuit supplies a stand-by signal to the second timer. When the user leaves the toilet, the detector stops generating the signal. Then, the judging circuit supplies a flushing signal to the first or second timer which has received the stand-by signal. Simultaneously, the flush valve is opened to flush the toilet. The valve remains open for the amount of time set by the timer which has received the flushing signal.

The predetermined period for which the output signal of the detector stays at a high level is longer than a normal period during which a cleaning person remains near the bowl of the toilet. Therefore, the delay circuit outputs no signals during the cleaning of the toilet. The time set to the first timer is shorter than that set to the second timer. Hence, the toilet is flushed for the short time set by the first timer when the judging circuit determines that the user has urinated, and for the long time set by the second timer when the judging circuit determines that the user has defecated. This can save water while cleaning the bowl.

Therefore, the apparatus of the invention can always keep the toilet clean, and can also prevent an unnecessary or excessive use of water, since it flushes the toilet only when the toilet has been used, with a small amount of water when the toilet has been used for urination and with a large amount of water when the toilet has been used for defecation.

BRIEF DESCRIPTION OF THE DRAWINGS

The present invention may be clearly understood as an embodiment is described with reference to the accompanying drawings, in which.

DETAILED DESCRIPTION OF THE PREFERRED EMBODIMENTS

Figure 1:
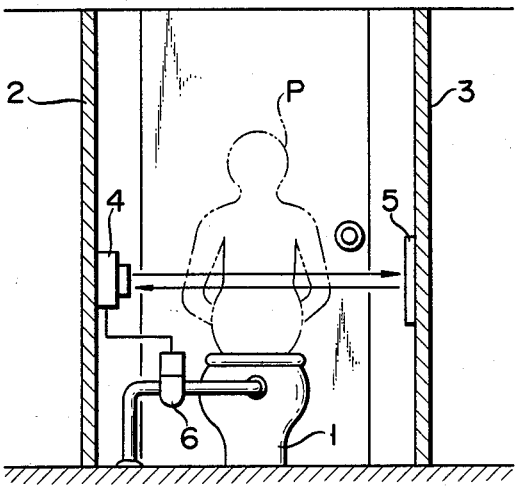
FIG. 1 schematically shows a bathroom equipped with an apparatus according to the present invention.

FIG. 1 shows a bathroom in which toilet 1 is installed. The toilet is a western-style one, but can be a Japanese-style one. A toilet-flushing control apparatus is also provided in the bathroom. The apparatus comprises housing 4 and reflector 5. Housing 4 is provided on one wall 2 of the bathroom, and reflector 5 is attached to the opposite wall 3 of the bathroom. The apparatus further comprises flush valve 6, provided on a flush pipe connected to toilet 1. Detector 10 for detecting a user seated on toilet 1, and a control circuit are provided within housing 4. When detector 10 detects the presence of a user, the control circuit actuates flush valve 6, thereby to flush toilet 1 and thus to clean the bowl of toilet 1.

Detector 10 and the control circuit will now be described with reference to FIGS. 2 and 3.

Detector 10 emits light to reflector 5, and senses the light reflected from reflector 5. The light is emitted from detector 10 and reflected back to detector 10 in a horizontal path located about 20 centimeters above toilet 1. Hence, as long as user P occupies toilet 1, the light beam can neither reach reflector 5 nor be reflected back to detector 10. Detector 10 can thereby detect that user P is seated on toilet 1. Detector 10 is not limited to an optical type; it can be replaced by one which emits ultrasonic waves and senses the ultrasonic waves reflected from wall 3, or by one which radiates a heat ray and senses the ray reflected from wall 3. Alternatively, any other type of a detector, which can detect that user P is seated on toilet 1, can be employed. Detector 10 is of the type which is commercially available.

The control circuit, provided within housing 4, comprises delay circuit 11, reference timer 12, timer-starting circuit 13, judging circuit 14, first timer 15, second timer 16, third timer 17, manual switch 18, amplifier circuit 19 and relay 20. Detector 10 supplies a signal to delay circuit 11 when it detects that the horizontal light beam path is blocked. Delay circuit 11 is designed to output a signal when the output signal of detector 10 lasts longer than a relatively short time, such as a few seconds. If the output signal of detector 10 lasts for this period or a shorter period, delay circuit 11 produces no signals, and is reset. Hence, if a cleaning person blocks the light beam path for a period equal to or shorter than said period of time, while sweeping the bathroom floor or cleaning toilet 1, delay circuit 11 produces no signals, thus preventing unnecessary flushings.

The signal output by delay circuit 11 is supplied to reference timer 12, timer-starting circuit 13, and judging circuit 14. Reference timer 12 is designed to supply a signal to judging circuit 14 upon lapse of a reference time of, for example, 90 seconds after the receipt of the signal produced by circuit 11, provided that the output signal of circuit 11 last 90 seconds or longer. This reference time of 90 seconds is based on the results of research, which showed that most adults finish urinating and leave toilet 1 within 90 seconds, but need a longer time to finish defecating and leave toilet 1. In view of the research, the reference time should probably be less than 90 seconds when the apparatus is used for the toilets which are installed in elementary schools and are thus used mostly by children, since it has been known that children use toilets for a shorter time than adults. It should be longer than 90 seconds when the apparatus is used for the toilets which are installed in hospitals or homes for the aged and are thus used mostly by those who take a relatively long time to finish urinating. Further, the reference time must be changed in accordance with the weather conditions, particularly the temperature, of the region where the apparatus is used. For instance, when the apparatus is used in a region of low temperature, the reference time should be long, since the people living in the region are heavily clothed and hence need a longer time to dress themselves.

When judging circuit 14 receives no signals from reference timer 12, after receiving the output signal of delay circuit 11, it determines that user P has urinated. On the other hand, when circuit 14 receives a signal from timer 12, after receiving the output signal of delay circuit 11, it determines that user P is defecating. Judging circuit 14 supplies a standby signal to first timer 15 when it determines that user P has urinated, and supplies the stand-by signal to second timer 16 when it determines that user P is defecating.

Timer-starting circuit 13 is a NOT circuit. It supplies a start signal to first and second timers 15 and 16 when the delay circuit stops producing a signal.

First timer 15 operates when it first receives the stand-by signal and then the start signal. Similarly, second timer 16 operates when it first receives the stand-by signal and then the start signal. In other words, first timer 15 is actuated when toilet 1 has been occupied by user P for a time less than 90 seconds, and second timer 16 is actuated when toilet 1 has been occupied for 90 seconds or longer.

A relatively short time is set to first timer 15, which operates when toilet 1 has been used for less than 90 seconds. A relatively long time is set to second timer 16 which operates when toilet 1 has been used for 90 seconds or longer. Timer 15 keeps generating a valve-opening signal for the short time, and timer 16 continues to generate a valve-opening signal for the long time. The valve-opening signal from either timer 15 or 16 is amplified by amplifier circuit 19 and then input to relay 20. Upon receipt of the valve-opening signal, relay 20 opens flush valve 6. Valve 6 remains open as long as the valve-opening signal lasts, thereby supplying water to the bowl of toilet 1 to flush toilet 1. The amount of water supplied to the bowl when first timer 15 operates is large enough to throughly clean the bowl after each urination. The amount of water supplied to the bowl when second timer 16 operate is greater, and is sufficient to wash away excrement, and thus throughly clean the bowl. Therefore, toilet 1 is kept clean, whether it has been used for urination or defeca- tion.

The time set to third timer 17 is shorter than that set to first timer 15, and needless to say, shorter than that set to second timer 16. Third timer 17 is started when manual switch 18 is operated by user P. Timer 17 starts generating a valve-opening signal when switch 18 is operated, and is reset upon lapse of the time set to it.

Third timer 17 and manual switch 18 are provided for flushing toilet 1 for a short time to drown out the noises produced during urination or defecation. People who do not want to have their urination or defecation overheard by other people can push switch 18, causing third timer 17 to output a valve-opening signal which lasts for a short period. Then, flush valve 6 opens for this period, thereby flushing toilet 1 with a small amount of water. The sound of the flushing water drowns out the noise made by urination or defecation. The sound of the water continues for some time even after flush valve 6 has been closed. Hence, the noise of urination or defecation can be completely drowned out by the sound of the flushing water though the time set to third timer 17 is short. Once third timer 17 has been set, it cannot be reset until the time it is set to elapses. Therefore, even if switch 18 is continuously or frequently pushed, toilet 1 is can be flushed more than once, however. This also prevents an excessive use of water.

Figure 3:
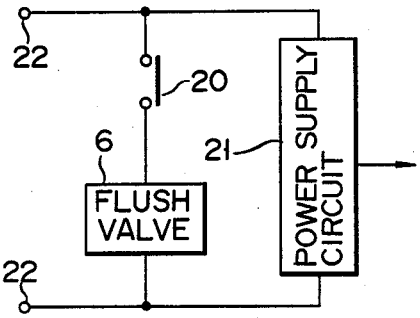
FIG. 3 is a block diagram of a circuit for actuating a flush valve.

FIG. 3 shows a circuit for actuating flush valve 6. As is shown in this figure, the valve-actuating circuit has two power supply terminals 22. Flush valve 6 and relay 20 are connected, thus forming a series circuit. This series circuit is connected at one end to one terminal 22, and at the other end to the other terminal 22. Stable power supply circuit 21 is also coupled at one end to first terminal 22, and at the other end to second terminal 22. Circuit 21 supplies power to the control circuit.

Figure 2:
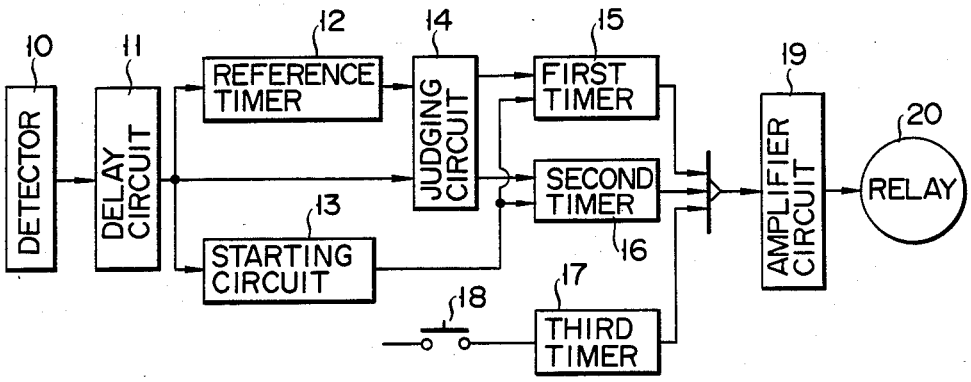
FIG. 2 is a block diagram of the circuit used in the apparatus of the invention.

The control circuit will be described in greater detail with reference to FIG. 4, wherein the elements shown in FIGS. 2 and 3 are represented by boxes of one-dot-one-dash lines and are designated by the same numerals as used in FIGS. 2 and 3.

First timer 15 includes variable-time timer 15*a*, and second timer 16 has variable-time timer 16*a*. Reference timer 12 contains fixed-time timer 12*a*. Timer 12*a* must be replaced by a variable-time timer when the apparatus is used in various regions of different climates, elementary schools, etc., and the reference time should therefore be changed.

Figure 4:
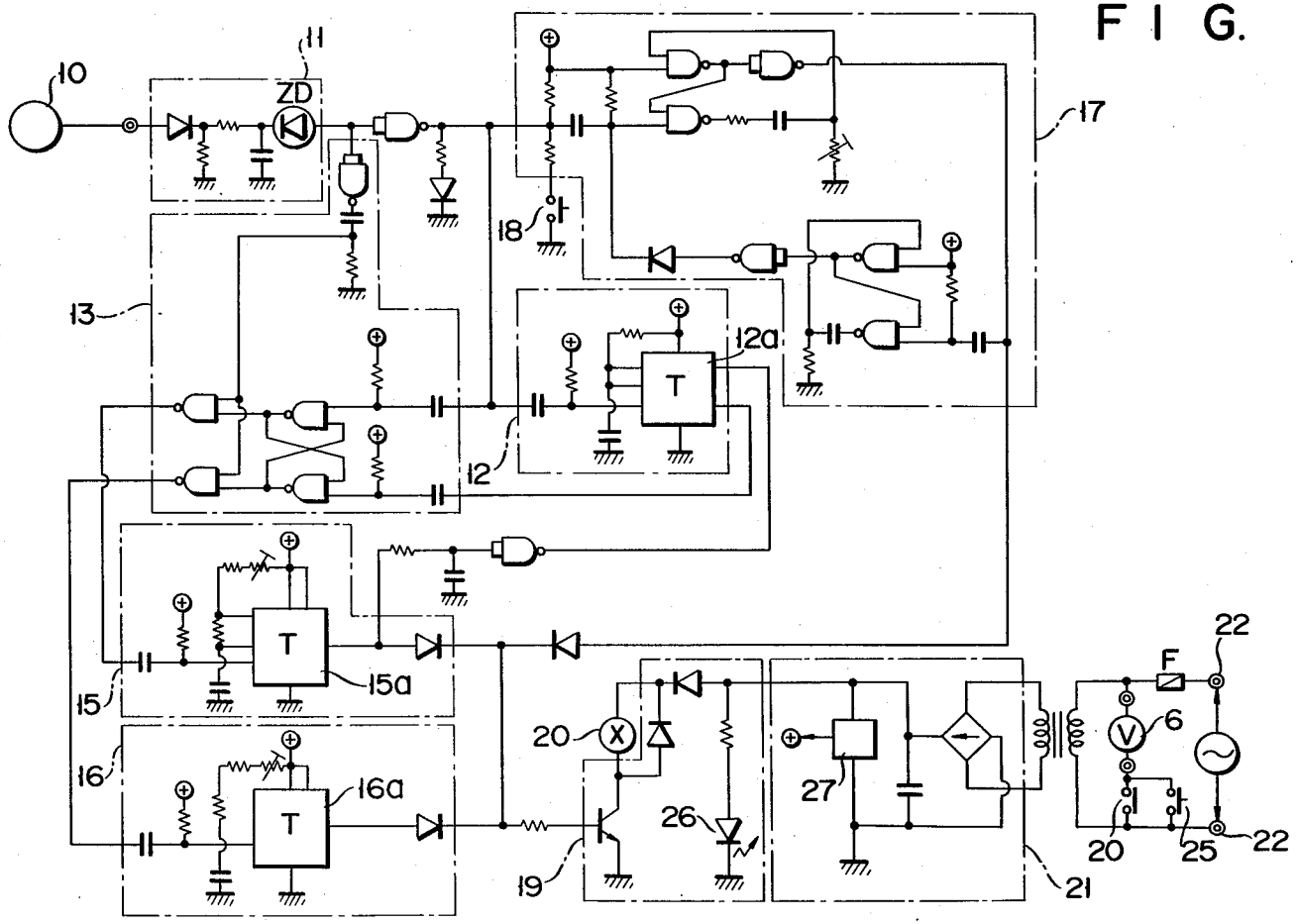
FIG. 4 shows the circuits of FIGS. 2 and 3 in more detail.

As shown in FIG. 4, the control circuit further comprises flush switch 25. This switch is closed to open flush valve 6, thereby to flush toilet 1 for a desired time if any component of the control circuit fails to perform its function. Flush switch 25 is located at such a high level that user P cannot operate it without standing up, lest switch 25 be closed to flush toilet 1, thereby defeating the function of third timer 17.

The present invention is not limited to the embodiment described above. Any person having ordinary knowledge and skill in the art can make various changes or modifications without departing from the spirit and scope of the invention. For example, the control circuit of FIG. 4 can be modified or redesigned.

What is claimed is:

1. An apparatus for automatically controlling the flushing of a toilet, said apparatus comprising:

detector means located in close proximity to said toilet is seated on said toilet, said detector means outputting a first signal upon detecting the presence of said toilet user;

a delay circuit connected to said detector means for receiving said first signal therefrom and outputting a second signal when said first signal of said detector means lasts longer than a predetermined period;

a judging circuit connected to said delay circuit for receiving said second signal therefrom, determining that the toilet user has urinated, when said second signal of said delay circuit lasts shorter than a reference time and outputting a first stand-by signal, and determining that the toilet user has defecated, when the output signal of said delay circuit lasts for the reference time or a longer time, thereby outputting a second stand-by signal;

a timer-starting circuit coupled to said delay circuit for receiving said second signal therefrom and outputting a start signal when said delay circuit ceases to output said second signal;

a first timer connected separately to said judging circuit and said time-starting circuit, for starting upon receipt of the start signal from said timer-starting circuit after receiving the first stand-by signal from said judging circuit, and for outputting a third signal until a lapse of time set to said first timer has expired;

a second timer connected separately to said judging circuit and said timer-starting circuit, for starting upon receipt of the start signal from said judging circuit after receiving the second stand-by signal from said judging circuit, and for outputting a fourth signal until a lapse of time set to said second timer has expired; and a flush value connected to said first and second timers for supplying water to the toilet for the time set to said first timer in response to the output signal of said first timer, or for the time set to said second timer in response to the output signal of said second timer.

2. An apparatus according to claim 1, wherein said detector means optically detects the presence of the toilet user.

3. An apparatus according to claim 1, wherein said detector means emits ultrasonic waves to detect the presence of the toilet user.

4. An apparatus according to claim 1, wherein said first and second timers are time-variable timers.

5. An apparatus according to claim 1, further comprising a third timer, the time set to which is shorter than the time set to said first timer and than the time set to said second timer, and a manual switch for starting said third timer, thereby to open said flush valve for the time set to said third timer.

6. An apparatus according to claim 5, wherein said third timer is reset upon lapse of the time set to it.

* * * * *